US010718587B2

(12) United States Patent
Barcherini

(10) Patent No.: US 10,718,587 B2
(45) Date of Patent: Jul. 21, 2020

(54) SILENCER DEVICE FOR FIREARM

(71) Applicant: Brevex S.A., Lausanne (CH)

(72) Inventor: Antonio Barcherini, Montazeau (FR)

(73) Assignee: BREVEX SA, Lausanne (CH)

( * ) Notice: Subject to any disclaimer, the term of this patent is extended or adjusted under 35 U.S.C. 154(b) by 21 days.

(21) Appl. No.: 16/318,929

(22) PCT Filed: Jul. 14, 2017

(86) PCT No.: PCT/EP2017/067873
§ 371 (c)(1),
(2) Date: Jan. 18, 2019

(87) PCT Pub. No.: WO2018/015301
PCT Pub. Date: Jan. 25, 2018

(65) Prior Publication Data

US 2019/0293377 A1 Sep. 26, 2019

(30) Foreign Application Priority Data

Jul. 18, 2016 (LU) ..... 93152

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/28; F41A 21/34; F41A 21/26; F41A 35/04
(Continued)

(56) References Cited

U.S. PATENT DOCUMENTS 652,742 A * 7/1900 Bernstein ..... F41A 35/04 89/31
832,695 A * 10/1906 Nygarrd ..... F41A 21/30 181/223

(Continued)

FOREIGN PATENT DOCUMENTS

DE 2238834 A1 * 2/1974 ..... F41A 21/30

*Primary Examiner* — Joshua E Freeman
*Assistant Examiner* — Bridget A Cochran
(74) *Attorney, Agent, or Firm* — Steven M. Shape; Dennemeyer & Associates, LLC

(57) ABSTRACT

The invention relates to a silencer device for a firearm, in particular for a rifle or another long or short firearm and a silencing method, which comprises: at least two closing flaps (10) mounted across the axis on the barrel of the firearm in order to provisionally seal the barrel after the ammunition has passed and to prevent the passage of the combustion gases and the sound wave towards the mouth of the barrel when a shot is fired, an actuation unit (2, 4, 5) including at least one opening (1, 3) made in the barrel of the firearm upstream from the closing flaps (10) to form a gas intake (1, 3) moving a control mechanism (6-9); the control mechanism (6-9) including at least two arms of an amplitude lever (8, 12) pivotably mounted on pivots (7) attached to the barrel, each arm of the amplitude lever (8, 12) being coupled to either one of the closing flaps (10), the actuating unit (2, 4, 5) engaging with the control mechanism (6-9) to allow a transverse movement of the closing flaps (10) between an open position in which the flaps (10) allow ammunition to pass towards the mouth of the barrel and a closed position preventing the passage of the combustion gases and the sound wave after the ammunition has passed, and an exhaust unit (11, 21-27) including at least one exhaust pipe (11, 21) arranged on the barrel upstream from the closing flaps (10) in order to redirect the combustion gases and the sound wave and allow them to be discharged from the barrel.

15 Claims, 9 Drawing Sheets

(58) Field of Classification Search
USPC ..... 89/14.4
See application file for complete search history.

(56) References Cited

U.S. PATENT DOCUMENTS

| | | | | | |
|---|---|---|---|---|---|
| 984,750 | A * | 2/1911 | Oraven | F41A 21/30 | 181/223 |
| 1,130,609 | A * | 3/1915 | Jones | F41A 21/30 | 181/223 |
| 1,763,286 | A * | 6/1930 | Wilman | F41A 21/30 | 181/223 |
| 1,763,287 | A * | 6/1930 | Wilman | F41A 21/30 | 89/14.4 |
| 1,773,443 | A * | 8/1930 | Wilman | C09B 49/10 | 89/14.4 |
| 4,939,977 | A * | 7/1990 | Stroup | F41A 21/30 | 89/14.4 |
| 5,746,018 | A * | 5/1998 | Kirschner | F41A 21/32 | 42/1.14 |
| 2012/0080261 | A1 * | 4/2012 | Shand | F41A 21/30 | 181/223 |

* cited by examiner

SILENCER DEVICE FOR FIREARM

CROSS-REFERENCE TO RELATED APPLICTIONS

This is a 35 U.S.C. 371 National Stage Patent Application of International Application No. PCT/EP2017/067873, filed Jul. 14, 2017, which claims priority to Luxembourg application 93152, filed Jul. 18, 2016, each of which is hereby incorporated by reference in its entirety.

TECHNICAL FIELD

In accordance with a first aspect, the present invention relates more specifically to a silencer for a firearm, such as a rifle or another long or short firearm.

In accordance with a second aspect, the invention proposes a method for silencing a firearm, in particular a rifle or another firearm, when a shot is fired.

In accordance with a third aspect, the invention proposes a firearm, in particular a rifle, including an improved silencer device.

PRIOR ART

With regard to the prior art, there exists the conventional silencer, also referred to as a noise regulator, which can be added to a firearm, gas weapon or air gun and which is aimed at mechanically reducing noise.

By way of example, publication WO 96/03612 discloses a noise moderating device for rifles for clay pigeon shooting or other recreational activities, having superposed barrels of all calibres. This firearm silencer is formed by a tubular encasement that is mounted on the barrel of the gun and includes an annular decompression chamber to the rear of said tubular encasement, as well as a series of internal cross baffles held by spacers and equipped with orifices allowing the passage of the lead shots and the wad. The silencer is intended to dampen the noise and thus reduce noise pollution.

Publications WO 2011/035111 A1 and WO 2014/000805 disclose further examples of firearm silencers, in particular for automatic rifles or another long or short firearm, including a silencer mounted on the barrel of the firearm, wherein a muzzle brake, which can be connected by screwing to the silencer, is fixed to the barrel.

Conventional Silencer

A conventional silencer or noise regulator is a device that can be added to a firearm, gas weapon or air gun in order to reduce the noise and light flash produced thereby when a shot is fired, thus making the weapon in question more stealthy.

To do this, the silencer generally takes the form of a cylindrical tube able to be adapted to the mouth of the barrel, and the internal mechanism of said tube, which mechanism varies depending on the ammunition used, makes it possible to reduce the pressure of gases used to propel the projectile, so as to mitigate their release into the atmosphere to the greatest possible extent.

Since the silencer merely slows the gas at the outlet of the barrel, it has no effect on the noise produced by the passage of the projectile at supersonic speed (speed greater than the speed of sound, which is approximately 340 m/s in air at 15° C.), which, by exceeding the sound barrier, in turn produces detonation noise over its path. This phenomenon is particularly noticeable in the case of calibres with high initial speed, such as 5.56 mm. For some cartridge calibres, in particular for handguns, there exists subsonic ammunition created specifically for use with a silencer so as to minimise the firing noise.

A silencer is above all a comfort tool because it reduces the muzzle wave of a firearm. This muzzle wave is the cause of ENT traumas, in the ear, nose and throat area, which the usual means (ear plugs, helmets, etc.) cannot provide protection against.

It should be noted that the two main factors affecting the value of the speed of the sound are the density and spring rate (or compressibility) of the propagation medium:

The lower the density and compressibility of the medium, the more quickly the sound will propagate. These two parameters change from one medium to the next. In helium, the compressibility of which is almost equal to that of air, but the density of which is much lower under the same temperature and pressure conditions, the speed of the sound is almost three times greater than in air. In a gas at atmospheric pressure, the speed of the sound is much lower than in a liquid: although the density of the gas is much lower, the gas is almost infinitely more compressible than the liquid (which is often considered incompressible). For example, the sound propagates exactly at 1,482.343 m/s in pure water at 20° C., approximately at 340 m/s in air at 15° C., and at around 1,500 m/s in seawater.

The effectiveness of silencers is relative: the noise reducer suppresses the muzzle wave and consequently the subsequent detonation and makes the noise thereof more diffuse whilst suppressing the flame at the mouth of the weapon. The term noise regulator is sometimes used; the performance of this type of device varies greatly depending on the type of noise reducer employed and the weapon used. The shorter the distance at which the shot can be heard, the more difficult it is to identify it as a shot from a firearm, and the more difficult it is to locate due to the distortion of the noise and also the absence of a visible flame. The magnitude of the noise is reduced by the order of 25 to 35 db in the case of an assault rifle, that is to say it is 115 to 125 db (comparable to a pneumatic drill) instead of 150 db.

The conventional silencers, whilst being provided in different forms and utilising different techniques, are nevertheless all rather similar. They are generally constituted by sleeves that are fixed to the end of the barrel, either by a bayonet system or by a threaded screw.

These sleeves, of substantial size, include a plurality of gas expansion chambers in their interior, which make it possible to attenuate the noise of the detonation with varying levels of success. The projectile, the gases and the residual sound wave exit via the mouth.

Their faults are as follows: significant weight (several hundred grams, perhaps more than a kilo), large dimensions, imbalance of the weapon (the nose drops), impossibility of use in double-barrel weapons and also, for the most part, with shot ammunition.

In addition, since the diameter of the holes separating the various elements of the silencer through which the projectiles pass is much larger than the calibre, they allow some of the gases to escape to the front of the projectile, thus interfering with the accuracy of the projectile and reducing the speed thereof approximately by 4 to 6 m/s.

The conventional silencer is costly, is difficult to maintain (it must be completely disassembled, part by part, for cleaning) and, for some rifle models, its lifetime is less than 800 shots.

As it passes through the various baffles, the projectile allows the gases behind it to expand in the cells, thus reducing the magnitude of the sound wave.

The effectiveness of a silencer of this kind is down to two factors: its dimensions (the larger it is, the more it damps), and the distance separating it from the combustion chamber (the greater the distance, the greater the effectiveness). Since the silencer is situated at the end of the barrel, the longer the length of said barrel, the more effective the silencer will be, therefore. Furthermore, there is practically no effect at all if the silencer is used with weapons having a very short barrel, unless the silencer is greatly oversized.

In this type of silencer, the reduction of the noise is dependent on the size of the chambers (cells). The noise normally produced by the detonation of a firearm is approximately from 120 to 170 db.

Thus, a sudden noise or extended exposure to excessive ambient noise (beyond 100 db) may cause a temporary or permanent change to a person's hearing.

In addition, implementation difficulties are also encountered in particular for certain conventional silencers or those that are not effective enough to reduce the noise when a shot is fired with the firearm, which results in certain problems.

SUMMARY OF THE INVENTION

It is therefore clear that there is a need for a system which, to a large extent, makes it possible to overcome the above-described disadvantages encountered in the prior art.

The object of the invention is to provide an improved silencer device for a firearm, in particular for a rifle or another long or short firearm.

Whereas a conventional silencer, also referred to as a noise regulator, endeavours to mechanically reduce noise, the aim of the present invention is therefore to propose a device for eliminating and completely preventing the noise produced when a shot is fired by allowing it to deplete naturally, thus resulting in greater stealth.

The aim of the device is therefore to inhibit the sound wave (the noise) generated by the ammunition of a firearm.

This object is achieved, in accordance with the invention, in that the silencer device for a firearm has the features of the characterising part of claim 1.

More particularly, to this end, in accordance with the invention, this aim is achieved in that the aforementioned silencer device comprises

- at least two closing flaps mounted across the axis on the barrel of the firearm in order to temporarily seal the barrel after a projectile has passed and to prevent the passage of the combustion gases and the sound wave towards the mouth of the barrel when a shot is fired,
- an actuation unit including at least one opening made in the barrel of the firearm upstream from the closing flaps to form a gas intake that moves a control mechanism,
- the control mechanism including at least two amplitude lever arms mounted pivotably on pivots attached to the barrel, each amplitude lever arm being coupled to either one of the closing flaps,
- the actuation unit engaging with the control mechanism to allow a transverse movement of the closing flaps between an open position, in which the flaps allow a projectile to pass towards the mouth of the barrel, and a closed position, which prevents the passage of the combustion gases and the sound wave after the projectile has passed, and
- an exhaust unit including at least one exhaust pipe arranged on the barrel upstream from the closing flaps in order to redirect the combustion gases and the sound wave and allow them to be discharged from the barrel.

Thus, in order to achieve this aim, the barrel is temporarily sealed with the aid of the closing flaps just after the passage of the projectile, and the combustion gases and the sound wave are redirected towards an expansion space for their final processing.

In one embodiment of the invention, the actuation unit preferably includes an activation piston, which is disposed in a cylinder fixed to the barrel and is extended by a rod, the gas intake made in the barrel moving the piston, extended by the rod, in a direction generally parallel to the axis of the barrel.

The control mechanism preferably includes a guide and transmission ring capable of sliding over the barrel, the ring cooperating with the rod of the piston so as to transmit the movement to the lever arms.

The closing flaps are preferably disposed in a seat placed across the axis of the barrel and are of a predetermined length and are slightly offset from one another along the axis of the barrel, such that they partially overlap one another in the closed position without contacting one another.

In one embodiment of the invention each flap includes an opening for receiving the end of the amplitude lever arm so as to transmit the pivoting movement of the amplitude lever and actuate the flap in a transverse direction relative to the axis of the barrel.

The guide ring preferably further comprises two wedge-shaped support parts having an angled-edge surface directed towards the flaps for enabling the actuation of the lever arms pivoting on the pivots and the closure of the flaps.

In one embodiment of the invention the control mechanism includes at least one first return spring associated with the guide ring such that said ring resumes its starting position, as the pressure of the gases reduces, and at least one second return spring associated with each of the lever arms so that the lever arms and the flaps resume their starting position, as the pressure of the gases reduces. The return springs of the lever arms can be removed by adding a lateral guide to the control mechanisms, which, when they retreat, return the arms to their starting positions.

In a further embodiment of the invention the actuation unit comprises a first and a second opening made in the barrel, the second opening forming a clutch valve actuated by a gas intake so as to allow the rod of the piston to be coupled to the control mechanism.

In a further embodiment of the invention the actuation unit includes an activation piston, which is disposed in a cylinder fixed to the barrel and is extended by a rod directly connected to the control mechanism by direct contact, the gas intake made in the barrel directly moving the piston, extended by the rod, in a direction generally parallel to the axis of the barrel.

The actuation unit preferably includes a return spring interposed between the barrel and an activation piston, extended by a rod, so as to allow the piston rod to resume its starting position, lowering the pressure in the gas intake.

In a further embodiment of the invention, the control mechanism includes double amplitude lever arms for actuating the flaps, and a guide ring that actuates two first amplitude lever arms mounted pivotably on pivots fixed to the barrel, each of the two first amplitude lever arms being coupled to a second amplitude lever arm mounted pivotably on another pivot fixed to the barrel in order to actuate the second associated amplitude lever arm, each of the two amplitude lever arms being coupled to one of the closing flaps.

The control mechanism is preferably positioned either upstream of the closing flaps or downstream of the closing flaps.

In a preferred embodiment of the invention the exhaust unit also comprises an expansion space connected to said at least one exhaust pipe so as to receive the gases transported by said at least one exhaust pipe, the expansion space including vents for discharging the combustion gases from the expansion space.

The expansion space preferably comprises an inner tube connected to flaps capable of sealing the vents, in which tube the gases enter the expansion space via an opening made in the inner tube once said tube has been pushed to its end position and has thus sealed the vents, and, as the pressure reduces, the inner tube resumes its starting position owing to a return spring, thus allowing the combustion gases to be discharged from the expansion space via the vents when the sound wave has depleted naturally.

In another embodiment of the invention (not shown), a second pair of flaps independent of the first ones is disposed at the outlet of the cartridge chamber and can be placed on automatic or semi-automatic weapons; these flaps actuated mechanically by separate discharge/reloading devices of the weapon serve to prevent combustion gases, the sound wave and the flash exiting via the open breech when the cartridge shell is ejected. This variant, using a second pair of flaps for automatic or semi-automatic weapons, can be used alone for simple modification of a weapon without resorting to the silencer, which, for its part, requires at least the replacement or the modification of the barrel.

In another embodiment of the invention the silencer device for a firearm, in particular for a rifle or another long or short firearm, comprises:

at least one closing flap mounted across the axis on the barrel of the firearm in order to temporarily seal the barrel after the ammunition has passed and to prevent the passage of the combustion gases and the sound wave towards the mouth of the barrel when a shot is fired, an actuation unit including at least one opening made in the barrel of the firearm upstream from the closing flap to form a gas intake that moves a control mechanism, the control mechanism including at least one amplitude lever arm pivotably mounted on a pivot attached to the barrel, the amplitude lever arm being coupled to the closing flap, the actuation unit engaging with the control mechanism to allow a transverse movement of the closing flap between an open position, in which the flap allows ammunition to pass towards the mouth of the barrel, and a closed position, which prevents the passage of the combustion gases and the sound wave after the ammunition has passed, and an exhaust unit including at least one exhaust pipe arranged on the barrel upstream from the closing flap in order to redirect the combustion gases and the sound wave and allow them to be discharged from the barrel.

In accordance with another aspect, the invention proposes a long or short firearm, in particular a rifle, comprising a silencer device of the aforementioned type, in which the barrel of the firearm comprises a fixing system formed by said pivots and a seat disposed across the axis of the barrel, said seat receiving said closing flaps so as to fix the silencer device to the barrel removably.

To this end, in accordance with a further aspect, the invention proposes a method for silencing a firearm, in particular a rifle or for another firearm, when a shot is fired, the method comprising the following steps:

temporarily sealing the barrel after a projectile has passed and preventing the passage of the combustion gases and the sound wave towards the mouth of the barrel when a shot is fired, by means of at least two closing flaps mounted across the axis of the barrel of the firearm, forming a gas intake by means of at least one opening made in the barrel of the firearm upstream from the closing flaps, moving an actuation unit and a control mechanism by way of the combustion gases in the gas intake, the control mechanism including at least two amplitude lever arms mounted pivotably on pivots attached to the barrel, each amplitude lever arm being coupled to either one of the closing flaps, generating, by means of the actuation unit and the control mechanism, a transverse movement of the closing flaps between an open position, in which the flaps allow a projectile to pass towards the mouth of the barrel, and a closed position, which prevents the passage of the combustion gases and of the sound wave after the projectile has passed, and redirecting the combustion gases and the sound wave and allowing them to be discharged from the barrel by means of an exhaust unit including at least one exhaust pipe disposed on the barrel and upstream from the closing flaps.

Thus, in order to achieve this aim, the barrel is temporarily sealed with the aid of one or more closing flaps just after the passage of the projectile, and the combustion gases and the sound wave are redirected towards an expansion space for their final processing.

Sound Waves When a Shot is Fired

There are, in principle, three sound waves which are generated by a fired shot. Two are produced within the barrel, and the third one is produced outside the barrel.

Inside the barrel the first sound wave is that produced by the combustion of the explosive charge. The second is the famous "bang" produced by the projectile as it passes the sound barrier, which is the case for approximately 96% of ammunition. This "bang" occurring inside the barrel is not certain, but assumed; however, it is certain that it is never produced outside the barrel. To the human ear these two sound waves are perceived to be a single noise. The third sound wave is produced with the exit of the projectile from the barrel, similar to a whiplash in the air. Said third sound has a magnitude of from 72 to 80 db and cannot in any way be controlled.

The combustion of the powder gives off an immediate heat of from 2500 to 3000° C., as well as 2-2.5 grams of gas which, not compressed, give a volume of approximately 1.12 $m^3$.

The sound wave produced by the combustion and the bang moves (at this temperature) at approximately 1500-1800 m/s (immediate speed) whereas the projectile is still in a phase of acceleration and reaches its maximum speed only after having travelled a distance of approximately 60 cm.

According to the invention, the sound wave has three properties of interest: the first is that, when it encounters an obstacle, it rebounds (echo phenomenon), the second is that it does not propagate in a vacuum, and the third and most interesting for the silencer device of the present invention is that it has a short life. It is therefore not possible in any way to store a sound wave: by preventing it from propagating it disappears.

The sound wave does not stick to the projectile. Upon striking it, the wave rebounds to the rear of the breech, which for its part returns the wave towards the projectile. It passes back and forth endlessly between these two obstacles, until the projectile exits via the mouth of the barrel, at variable speed depending on the temperature of the medium through which it passes and that of the gases carrying it. The sound wave then propagates in the air at the exit of the barrel.

Whereas a conventional silencer of the aforementioned kind, also referred to as a noise regulator, endeavours to mechanically reduce noise, the silencer of the present invention allows it to completely deplete naturally and manages to eliminate it completely by keeping the sound inside the barrel for a very short time.

In addition, the silencer device for a firearm of the present invention is advantageous in terms of weight (approximately 50 g in total), manufacturing cost and effectiveness.

According to the invention, the sound wave produced within the barrel is completely destroyed because it is retained behind the flaps. The tiny proportion of the gases which, at the time of closure of the flaps, is disposed ahead of said flaps between said flaps and the base of the projectile expands gradually in the space situated between the flaps and the mouth of the barrel, that is to say approximately an average distance of around 10 cm, where it also encounters an air void brought about by suction by the projectile. Solely the noise produced by the sound wave generated outside the barrel thus remains.

In fact, the silencer device for a firearm of the present invention allows the sound wave to deplete naturally and above all deals with the pressure generated by the gases. If there were no escape provided by an exhaust pipe, the gases would remain compressed within the barrel, keeping the flaps are closed. They would expand solely at the opening of the rifle, without posing any danger but with some disadvantages. Although, in the case of an automatic or semi-automatic weapon, the gases would be discharged via the breech, according to the invention it has been deemed preferable to increase the inner volume of the barrel by one or two exhaust pipes. This additional volume lowers the pressure of the gases and allows the flaps to open by means of the system of return springs and allows the gases to escape naturally simultaneously in a forwards direction and via the end of the exhaust temporarily sealed by flaps of a size similar to those arranged on the barrel. The reduction in the pressure of the gases inside the barrel is also brought about by the quick cooling of said gases.

BRIEF DESCRIPTION OF THE FIGURES

Further features and advantages of the invention will become clear from reading the following detailed description. Also, in order to provide a clearer understanding of the invention, several preferred embodiments will be described hereinafter by way of example, with reference in particular to the accompanying figures, in which.

EMBODIMENTS OF THE INVENTION

The present invention is described on the basis of particular embodiments and with reference to the figures, but the invention is not limited thereto. The drawings or figures described are merely schematic and are not limiting.

Figure 1:
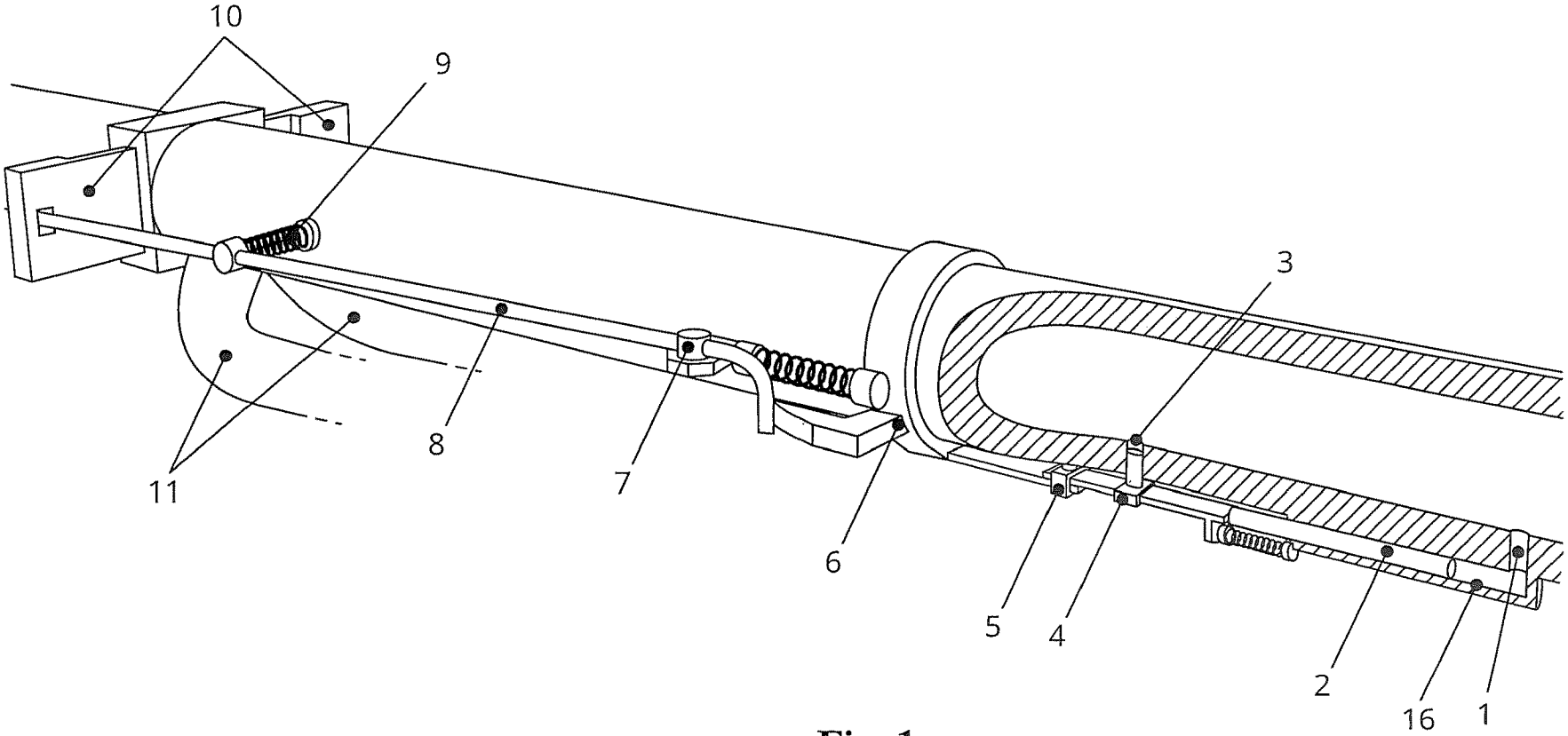
FIG. 1 shows a silencer device for a firearm in an embodiment of the invention.

FIG. 1 shows a silencer device for a forearm in an embodiment of the invention.

In accordance with the preferred embodiment shown in FIG. 1, two closing flaps (10) are mounted across the axis on the barrel of the firearm in order to temporarily seal the barrel after a projectile has passed and to prevent the passage of the combustion gases and the sound wave towards the mouth of the barrel when a shot is fired. The actuation unit (1-5) includes a first opening (1) made in the barrel upstream from the closing flaps (10) so as to form a gas intake (1) and move the control mechanism (6-9).

The control mechanism (6-9) includes two amplitude lever arms (8) mounted on pivots (7) so as to allow a transverse movement of the two closing flaps (10) between an open position, in which the flaps (10) allow a projectile to pass towards the mouth of the barrel, and a closed position, which prevents the passage of the combustion gases and the sound wave after the projectile has passed.

The exhaust unit (11) includes two exhaust pipes (11) arranged upstream from the closing flaps (10) in order to redirect the combustion gases and the sound wave and allow them to be discharged from the barrel.

Figure 2:
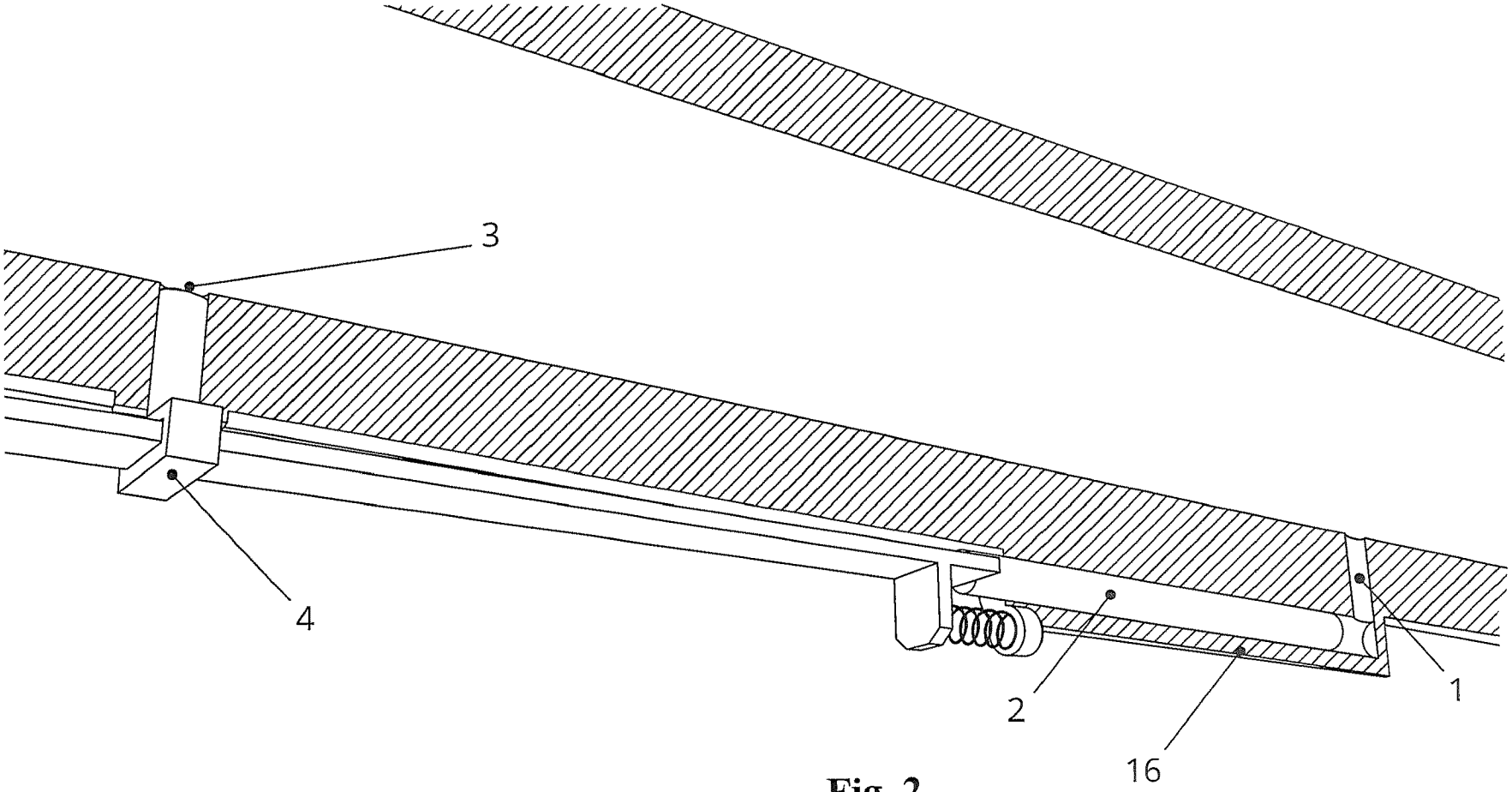
FIG. 2 shows a partial side view of the device as shown in FIG. 1.

As can be seen in FIG. 2, by means of the pressure of the gases, the gas intake (1) made in the barrel at any point after the chamber moves a control piston (2) of the device disposed in a cylinder (16) and extended by a rod (2). The rod (2) of the piston is positioned in a direction generally parallel to the axis of the barrel defining the direction of the projectile.

The control piston having the rod (2) is associated with a return spring disposed on the barrel. As the pressure decreases, the rod of the piston (2) resumes its starting position thanks to the return spring.

As a projectile passes a point defined by a second gas intake (3), a clutch valve (4) is actuated so as to allow the coupling of the rod of the piston (2) to the transmission (5), which moves the control mechanism (6). The clutch valve (4) and the transmission (5) are coupled by friction.

The control mechanism (6-9) is positioned upstream from the flaps (10).

The control mechanism (6) actuates the amplitude lever arms (8), which close the flaps (10), thus allowing the gases to be discharged via the pipes (11). The flaps (10) (and their seat) are preferably disposed across the axis of the barrel and are of a predetermined length and are slightly offset from one another along the axis of the barrel, such that they partially overlap one another in the closed position without contacting one another. Advantageously, each flap (10) includes an opening for receiving the end of the amplitude lever arm (8) so as to transmit the pivoting movement of the amplitude lever (8) and actuate the flap (10) in a transverse direction relative to the axis of the barrel. The elements (2, 4, 5, 6) of the actuation mechanism are moved in a direction generally parallel to the axis of the barrel.

Preferably, the control mechanism (6-9) includes a guide ring (6) that is capable of sliding over the barrel and is equipped with a transmission extension (5), which cooperates with the rod of the piston (2) so as to transmit the movement to the lever arms (8).

The rod of the piston (2) is coupled to the control mechanism (6) by the transmission extension (5) so as to move said mechanism.

The guide ring (6) advantageously further comprises two wedge-shaped support parts disposed laterally to the axis of the barrel and having an angled-edge (rectilinear or curvilinear) surface directed towards the flaps (10) for enabling the actuation of the lever arms (8) pivoting on the pivots (7) and the closure of the flaps (10). A first return spring is associated with the guide ring (6) so that said ring resumes its starting position as the pressure reduces. A second return spring (9) is associated with each of the lever arms (8) so that the lever arms (8) and the flaps (10) resume their starting position as the pressure reduces. The return springs (9) of the lever arms can be removed by adding a lateral guide (not shown) to the control mechanisms (6 and 15), which, when they retreat, return the arms to their starting positions.

The passage of the projectile at the position (3) actuates the valve (4), which places the rod of the piston (2) in contact with the extension (5) of the ring (6), transmitting thereto the movement, which allows this ring to actuate the lever arms (8) on the pivots (7), which close the flaps (10), the gases thus being diverted towards the exhaust (11).

The valve (4) acts as a clutch element (4) which is moved downwardly to couple the rod of the piston (2) to the transmission (5). Thus, the clutch element (4) pushed downwardly by the gases in the opening (3) as the bullet passes through locks the element (4) of the rod (2) on the extension (5) of the ring (6), transmitting the movement thereto.

Figure 3A:
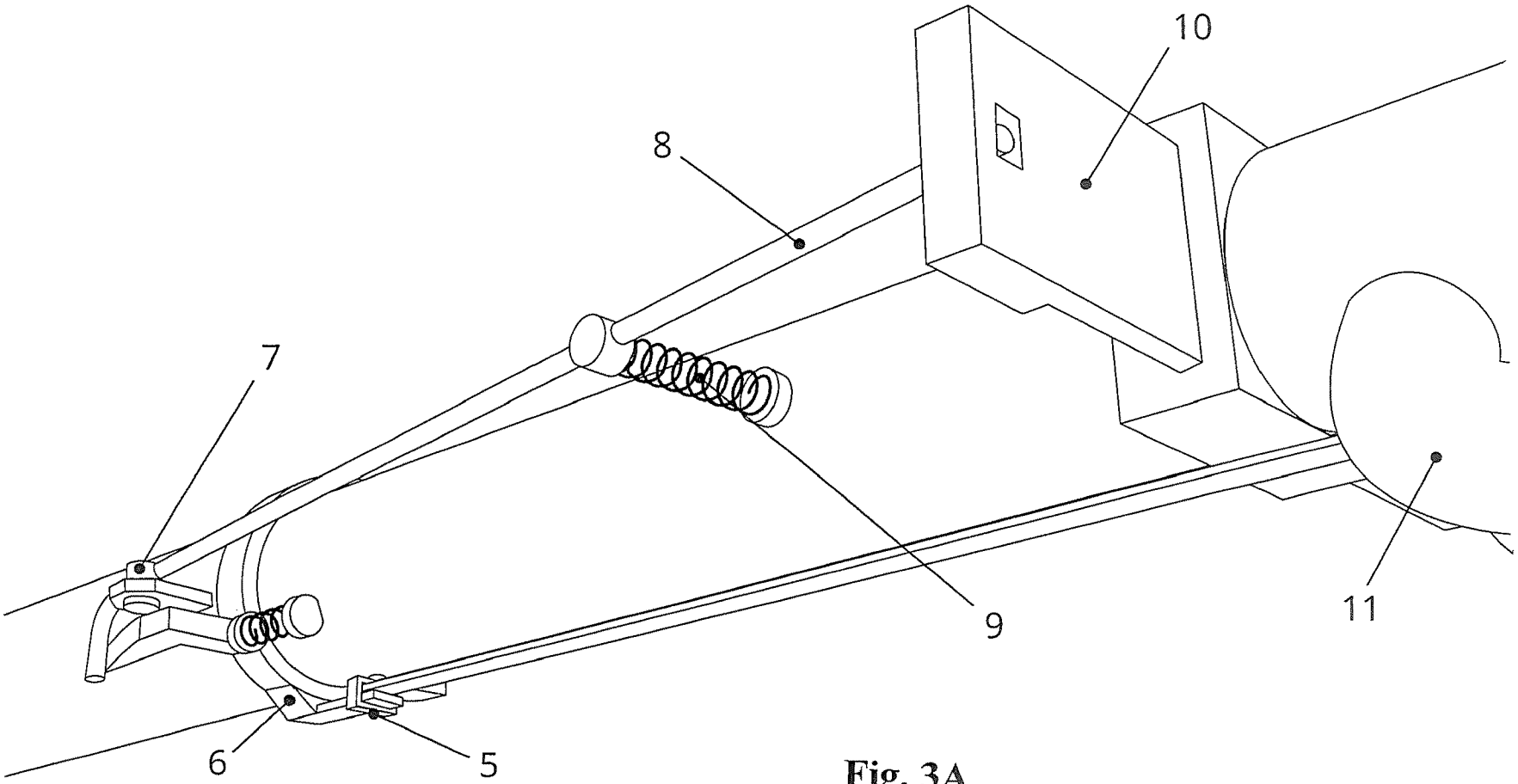
FIG. 3A shows a partial side view of a silencer device for a firearm in another embodiment of the invention.
Figure 3B:
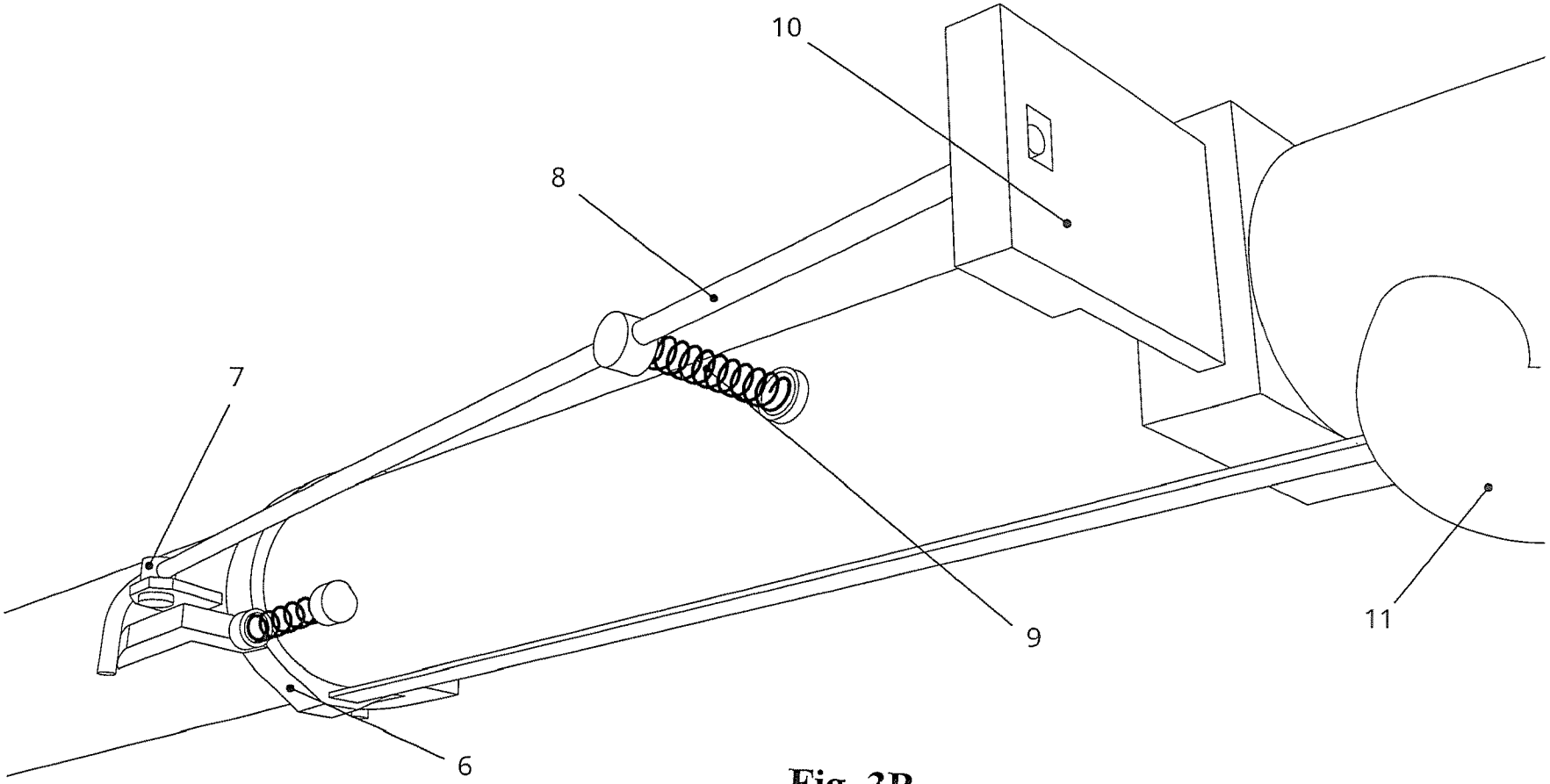
FIG. 3B shows a partial side view of a silencer device similar to FIG. 3A in another embodiment of the invention.

In accordance with the embodiment shown in FIG. 3A, the parts 5 to 9 of the control mechanism are position downstream from the flaps (10). FIG. 3B is similar to FIG. 3A; however, the clutch valve and the transmission (5) are omitted in this embodiment and there is direct coupling of the rod of the piston to the control ring (6).

In all the variants shown in FIGS. 1 to 6, the linkage of the control mechanism (6-9) is composed of two amplitude lever arms (8) which are mounted on pivots (7) and which, when actuated by the control ring (6), close the two flaps (10).

Figure 4:
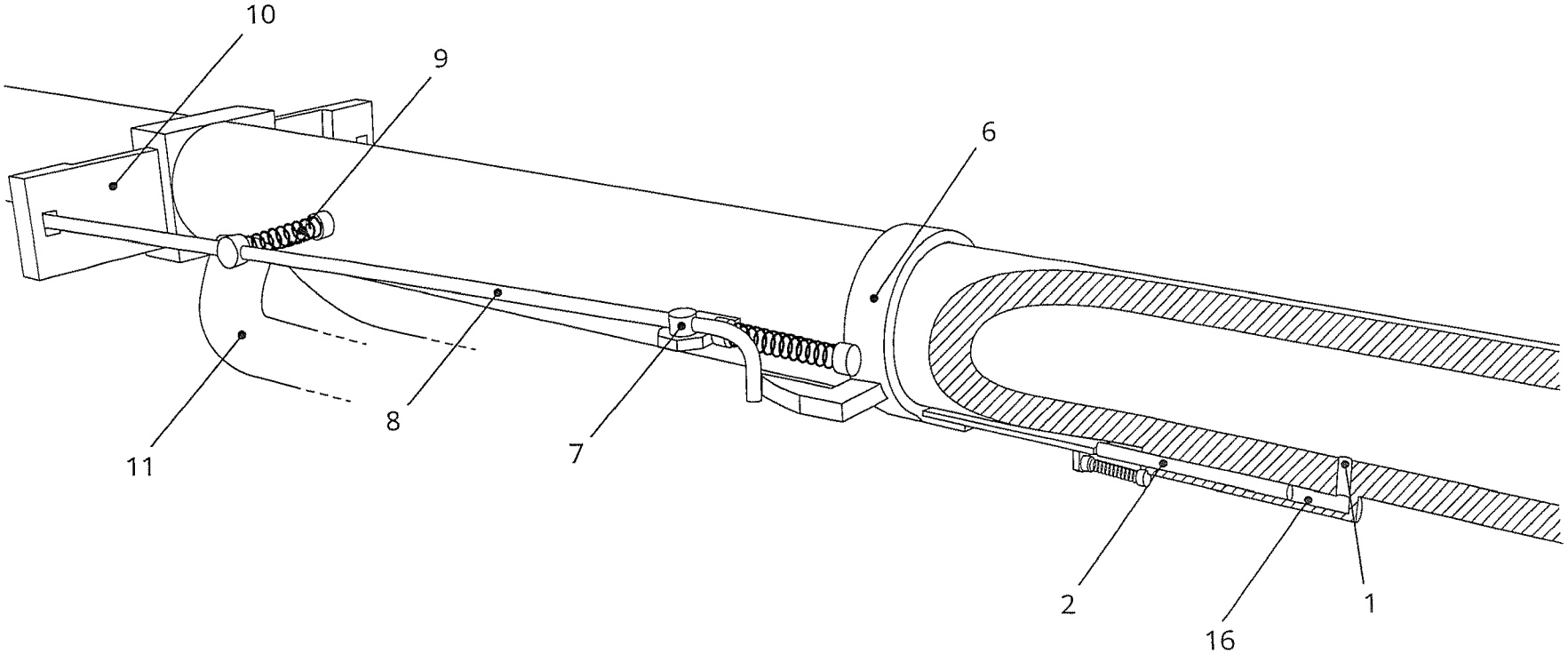
FIG. 4 shows a side view of a silencer device for a firearm in another embodiment of the invention.
Figure 5:
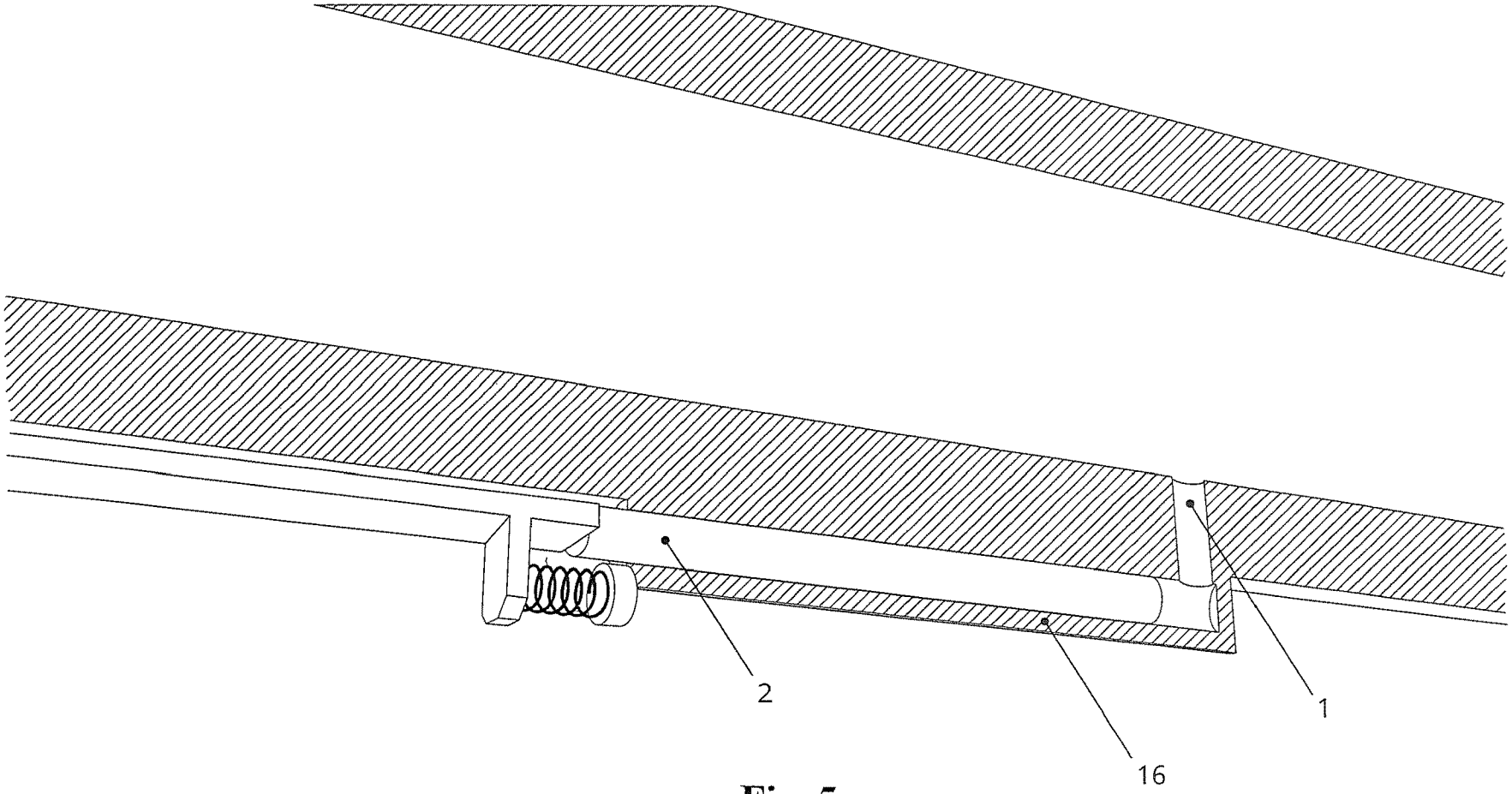
FIG. 5 shows a partial side view of the device as shown in FIG. 4.
Figure 6:
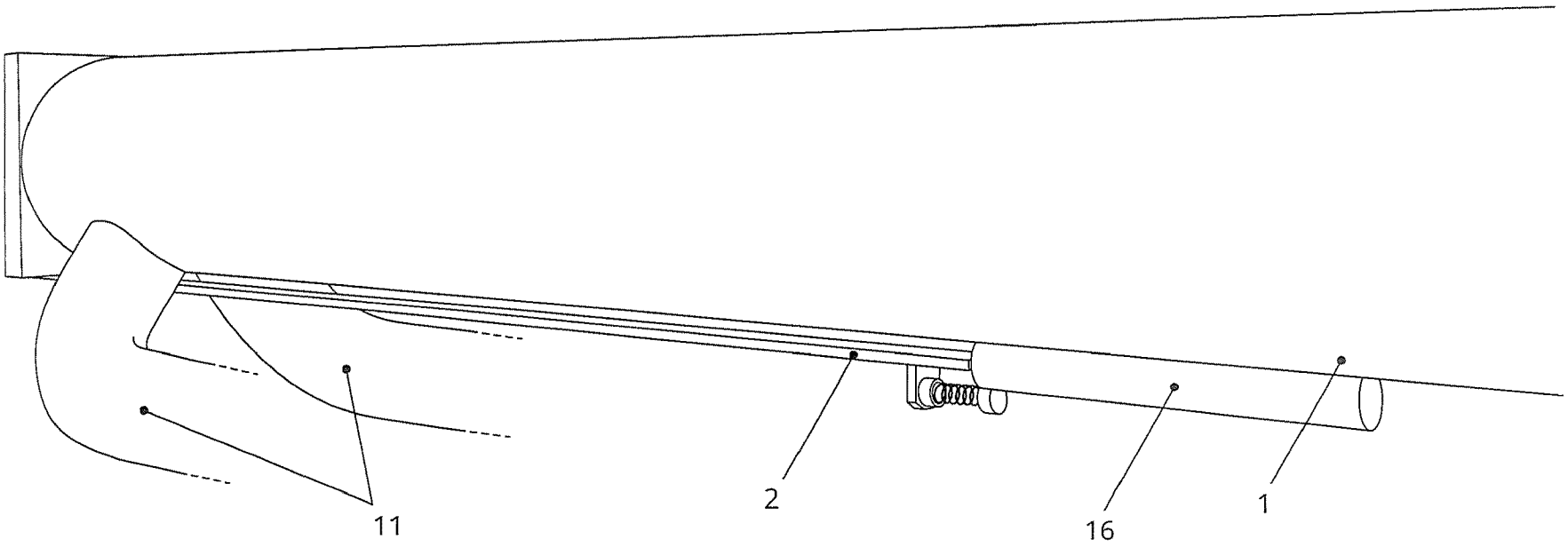
FIG. 6 shows a partial side view of a silencer device for a firearm in another embodiment of the invention.

In accordance with the embodiment shown in FIGS. 4 and 5, the piston (2) of the device, disposed in the cylinder (16) and extended by the rod (2), is directly connected to the control mechanism (6-9). For certain short-barrel weapons, it is possible to dispense with parts 3, 4 and 5. Thus, the second gas intake (3), the clutch valve (4) and the transmission (5) are omitted in this embodiment and there is direct coupling of the rod of the piston (2) to the control ring (6).

As can be seen in FIG. 4, the piston (2) is connected to the control mechanism (6) by direct contact. In fact, the piston (2) and the control mechanism (6) are practically made in one piece. The piston (2) and the control mechanism (6) can be integrated and formed in one piece. The version in FIGS. 4 and 5 is provided above all for short-barrel weapons, but this is not mandatory.

Furthermore, in this variant shown in FIG. 4, it is also possible to choose to position the linkage of the control mechanism (6-9) either upstream (FIG. 4) or downstream from the flaps (10), as in the embodiment in FIGS. 3A and 3B.

In all the variants shown in FIGS. 1 to 6, the linkage of the control mechanism is composed of two amplitude lever arms (8) which are mounted on pivots (7) and which, when actuated by the control mechanism (6), close the flaps (10).

The variant of FIG. 3A is comparable to the variant of FIG. 1, except that the closing mechanism is positioned after the flaps, so as to shorten the entire assembly.

In all the variants above, the linkage is composed of two amplitude lever arms (8) which are mounted on pivots (7) and which, when actuated by the control mechanism, close the flaps (10).

In this case, the arms (8) are provided so as to give a lever with an amplitude of 10, that is to say the proportion of the arm between before and after the pivot is from 1 to 10, that is to say a total length of 11 units. The amplitude (10 in this case) can be increased or decreased as desired.

The variant of FIG. 4 is provided above all for short-barrel arms; however, the advantage of the variant of FIG. 1 having a second gas intake (3) which pushes a clutch element (4) is that the piston (2) will be already in motion from the time at which the projectile passes through, and therefore the coupling triggered by the clutch element (4) involves a part already in motion, which accelerates the mechanism for closing the flaps.

It should be noted that the time that passes between the percussion of the cartridge and the exit of the projectile from the barrel is approximately from 1.2 to 2.4 milliseconds.

Figure 7:
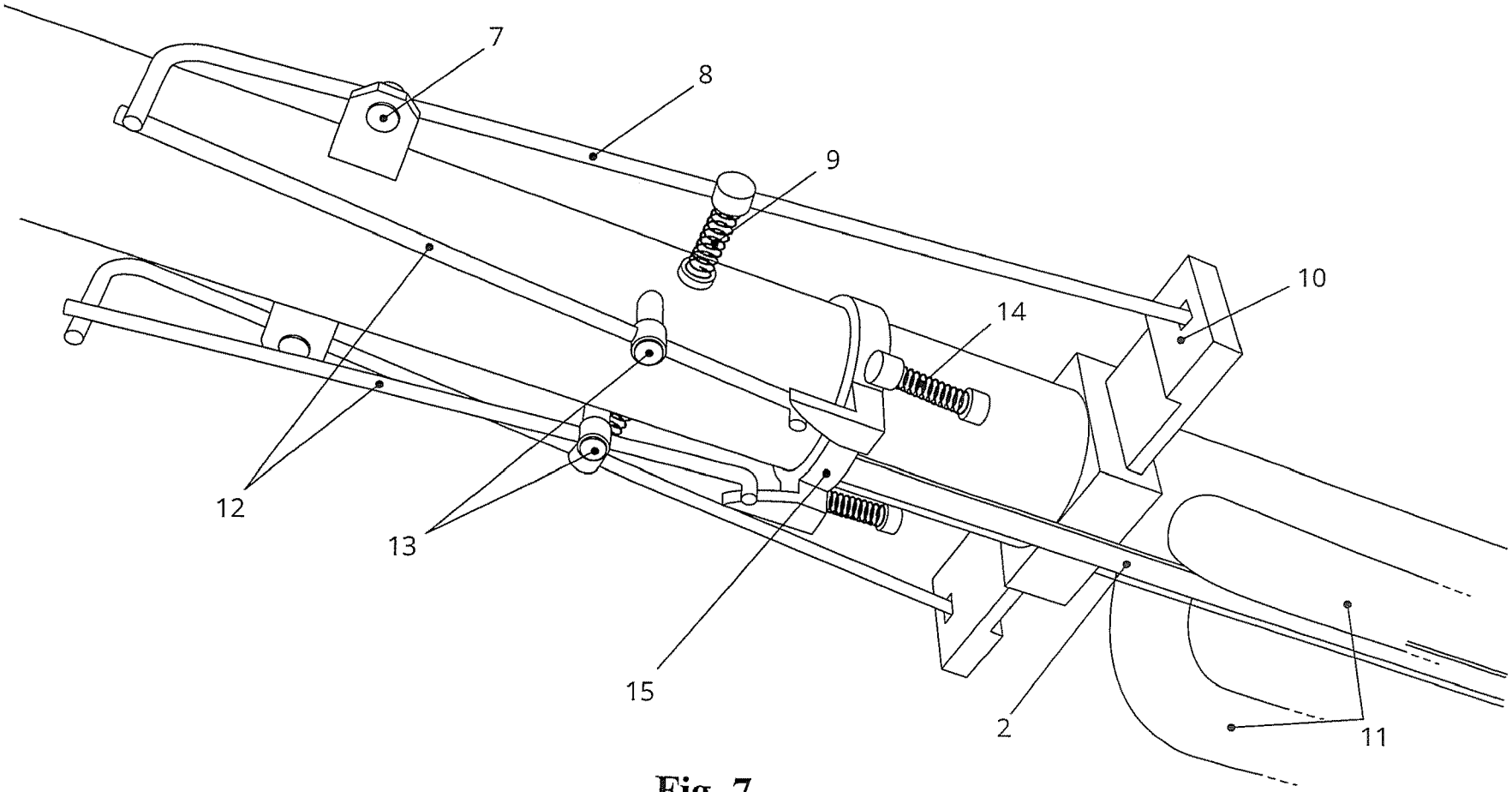
FIG. 7 shows a partial side view of a silencer device for a firearm in another embodiment of the invention.

In accordance with the embodiment shown in FIG. 7, for technical reasons and so as to gain space, the lever arms (8 and 12) are doubled, and the overall arrangement is positioned either upstream from the flaps (10), as shown in FIG. 7, or downstream from the flaps (not shown).

More specifically, as can be seen in FIG. 7, the control mechanism (15) actuates the double amplitude lever arms (8, 12), which close the flaps (10), thus allowing the gases to be discharged via the pipes (11). The control mechanism (15) includes a guide ring (15) which actuates two first amplitude lever arms (12) mounted pivotably on pivots (13) fixed to the barrel, and these two first amplitude lever arms (12) are coupled to two second amplitude lever arms (8) mounted pivotably on pivots (7) fixed to the barrel. Each of the two first amplitude lever arms (12) actuates one of the second associated amplitude lever arms (8), each of the two second amplitude lever arms (8) being coupled to one of the closing flaps (10).

The other elements in this variant are similar to those of the embodiments shown in FIGS. 1 to 6.

It should be noted that the control mechanism (15) spreads the amplitude lever arms (12) apart, whereas the control mechanism (6) of the other embodiments brings the amplitude lever arms (8) closer to one another.

In this variant shown in FIG. 7, it is also possible to choose to position the linkage of the control mechanism (7-9, 12-15) either upstream or downstream (FIG. 7) from the flaps (10), as in the embodiment in FIG. 1.

This variant of FIG. 7 makes it possible to shorten the system for closing the flaps. In this variant, the amplitude levers, which have a ratio of 1 to 10 (and therefore a total length of 11 units), are each replaced by two entwined levers 2, the longest having a ratio of 1 to 4 (and therefore a total length of 5 units), and the second having a ratio of 1 to 2.5; the value of 1 to 10 (4×2.5) is thus given for a total length of 5 units instead of 11 units.

The entire mechanism could be protected by a standard-use cover and could prevent damage when used with a firearm; however, this will be dependent on the weapon in question and its components. Since the cover is not essential for correct functioning, it will not be described in greater detail.

Figure 8:
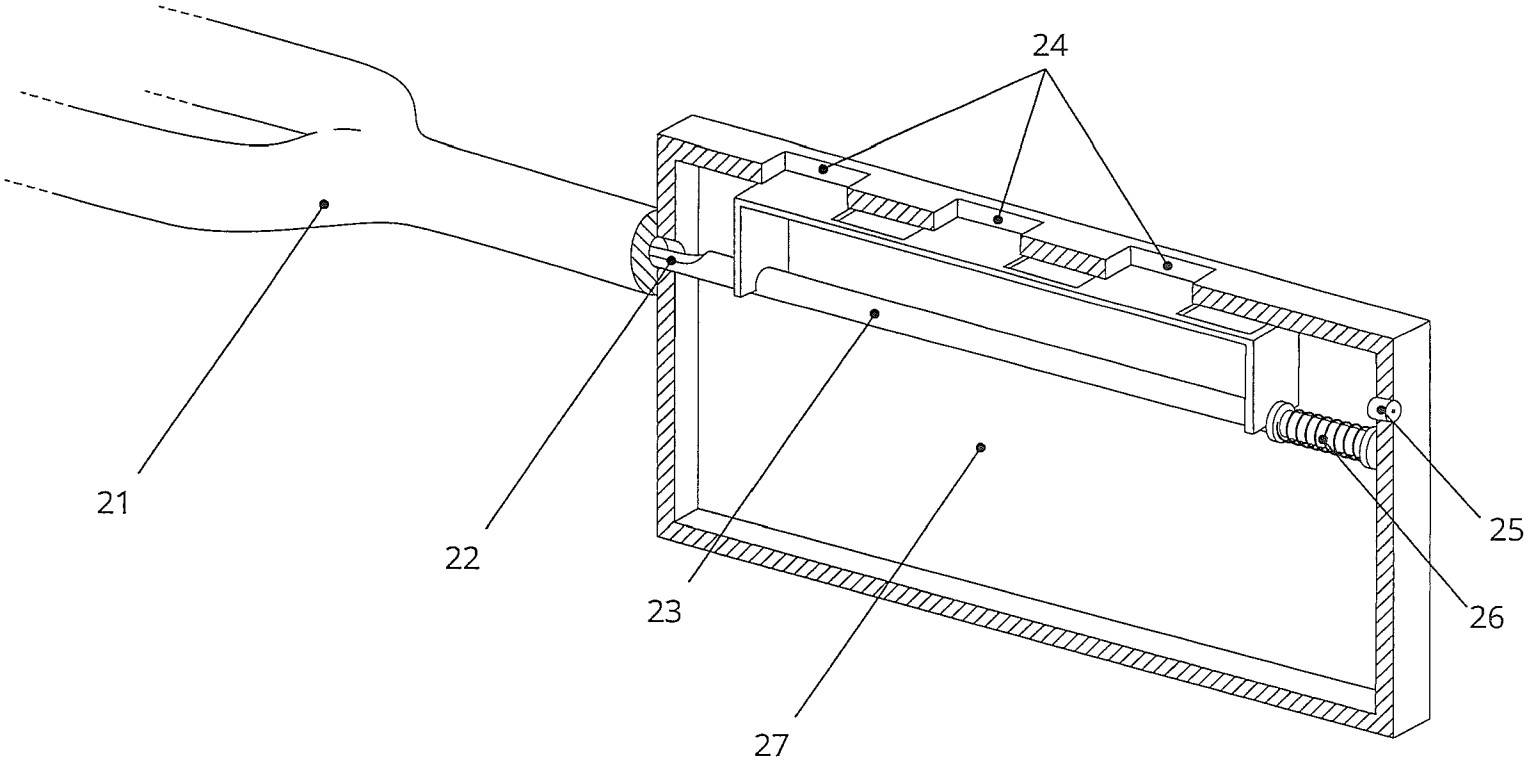
FIG. 8 shows a side view of an exhaust unit of the silencer device for a firearm in an embodiment of the invention.

As can be seen in FIG. 8, in accordance with a preferred embodiment of the invention, an expansion space having a timer (22-27) is associated with the exhaust pipes (21) for processing the recovered gases and inhibiting the sound wave. Further solutions are possible.

In accordance with the embodiment shown in FIG. 8, the expansion space 27 is coupled to the exhaust pipes (21) and comprises an internal bar (23) moved by the pressure of the gasses in order to redirect these gases. The expansion space 27 receives the gases carried by the recovery pipes (21), which gases enter the expansion space 27 via the opening (22) made in the bar (23) once said bar has been pushed to its end position and has thus sealed the openings (24). A pressure relief valve (25) is provided (but could be replaced by small holes). As the pressure reduces, the bar resumes its starting position owing to the return spring 26 and the gases are discharged via the vents (24).

Operating Principle and Details

The final aim of the device provided by the invention described here is that of inhibiting the sound wave produced by the firing of the ammunition (rifle shot).

This stopper intended to inhibit the sound wave produced by the firing of the ammunition (rifle shot) prevents the combustion gases and sound waves from exiting via the mouth of the barrel by diverting them towards a suitable processing zone, whilst leaving the properties of the ammunition itself (speed, accuracy, etc.) unaffected.

Principle:

a) a sound wave has a short life;

b) it cannot be preserved;

c) it is stopped by any obstacles (in which case it rebounds—resonance), whether said obstacle is stationary or is moving;

d) it does not propagate in a vacuum.

When a shot is fired, two sound waves are in principle generated within the barrel, one each by the following:

1) The detonation produced by the explosion;

2) The typical "bang" when the sound barrier is passed.

The sound waves follow the projectile; although the speed of sound in a gaseous medium is variable (it can reach very high values depending in particular on the temperature of the gases), the sound wave does not stick to the projectile within the barrel; if the speed of the wave is greater than that of the projectile, the wave moves back and forth within the barrel. The speed of the projectile may vary between 250 and 950 m/s depending on the calibre and type of ammunition.

Practical Application:

Recognising that the maximum speed of a projectile is reached after 60 cm of travel in practice, after this distance an opening of suitable size to redirect the gases is made in the barrel, and, just after this opening, a transverse rail having a left-hand flap and a right-hand flap (or lower and upper flaps) is incorporated into the barrel, each flap intended to seal a transverse half of the barrel by superposition. The two flaps are actuated by an amplitude lever. The lever(s) of each flap is/are actuated by a control mechanism moved by recovery of gas.

This is effective for weapons referred to as long weapons; for short weapons the position of the device is selected accordingly.

A volume of gas situated after the combustion chamber moves the mechanism via a conduit (at the same speed as the projectile, or faster), said mechanism preferably being composed of the following:

i) a mechanical or hydraulic closure valve having one flap (solid or hinged) or preferably having two juxtaposed flaps (two halves overlap, improved solution because it is quicker), having a diaphragm (of the camera shutter type), having a blade; return spring;

ii) a control device and kinetic motivity by gas recovery;

iii) a sealed expansion space;

iv) possibly an autonomous device for resetting.

By way of example, the flap valve (single flap or double flap) will close the barrel once the projectile has passed through; moving at the same speed as the projectile, the distance covered by the latter prior to the full closure of the barrel will be equal to the inner diameter of the barrel—it will be half in the case of use of a double flap (DV): for 7 mm ammunition the distance will therefore be 7 mm (DV: 3.5 mm.); for 12-calibre with 18.4 mm shot, it will be 18.4 mm (DV: 9.2 mm). The volume of gas that the valve will have thus allowed to pass before closing will therefore be 2.69 $cm^3$ (DV: 1.35 $cm^3$) for 7 mm ammunition and 4.89 $cm^3$ (DV: 2.45 $cm^3$) for a 12-calibre rifle.

The tests performed successfully were:

A) neutralisation of the gases in the expansion space;

B) closure of the barrel after passage of the projectile by means of a flap valve;

C) increase in the working speed of the device by reduction of the cross section of the gas recovery tube (pressure increase).

In summary, the following will be provided:

i) one closing flap or two opposite closing flaps on two slightly offset axes, so as to avoid contact;

ii) control device (kinetic motivity by gas recovery) with spring return;

iii) amplitude lever mechanisms on each side;

iv) opening(s) for redirecting the gases.

All dimensions for the components must be defined depending on the calibre of the weapon, the mean speed of the specific ammunition, and the materials used for the production of the components; the total amplitude factor established by the levers can be freely defined. The reduction of the intensity of the noise (sound level) can be approximately from 50 to 70 dbA, or more, in the case of a long firearm. The residual noise is that created by the projectile flying through the air.

Processing of the Gases and Sound Wave

The combustion gases are recovered by making a hole in the barrel. These gases move a control piston, the rod (2) of which serves to actuate the closing mechanism, with or without the involvement of a transmission valve (4) actuated by the gases recovered once the projectile has passed through. The closing mechanism consists of lever arms (8) actuated by a part (5), the shape of which can be variable.

Once the projectile has passed the flaps, these close very quickly and the gases are directed towards one or two exhaust pipes leading to an expansion space having a timer. The gases carried by the recovery pipes (21) enter the expansion space via the opening (22) made in the bar (23) once said bar has been pushed to its end position and has thus sealed the openings (24). A pressure relief valve (25) is provided (but could be replaced by small holes). As the pressure reduces, the bar resumes its starting position owing to the spring (26) and the gases are discharged via the vents.

Operating Sequence

Some of the combustion gases are recovered via an orifice made in the barrel (1) at any point after the chamber and they move a piston extended by a rod (2), which serves to actuate the mechanism at the appropriate time. The passage of the projectile at the position (3) actuates the valve (4), which places the rod of the piston (2) in contact with the extension (5) of the ring (6), transmitting thereto the movement, which allows this ring to actuate the lever arms (8) on the pivots (7), which close the flaps (10), the gases thus being diverted towards the exhaust (11) and then processed in the expansion space (27).

It goes without saying that the shape, the length and all other properties of each of the components can be different from those disclosed here, which are stated to ensure sound understanding.

In particular, the ring (6) should in fact move on the whole only between 0.6 and 2 mm depending on the calibres and selected amplitude of the levers.

In all of the variants shown in FIGS. 1 to 7 the flaps (10) close after the passage of the projectile and before the arrival of the sound wave at the flaps, so as to thus allow the gases to be discharged via the pipes (11).

Therefore, in accordance with a preferred embodiment of the invention, for a long firearm, the following should therefore be noted:

Exhaust openings should be made after a distance of 60 centimetres, to which the expansion space will be applied tightly, said openings being of a size suitable to contain the combustion gases; this expansion space (27) could have any shape and could be made of any material (solid or resilient); it could be applied at any point of the weapon (for example laterally on the barrel or beneath);

Just downstream of these openings, there should be a flap (10) support incorporated during the process for manufacturing or modifying the barrel;

The flap device should be actuated by a linkage.

The moving of the device as a whole should be controlled for example by a piston of approximately 4-5 mm in diameter having a rod (2) at the end, disposed in a tube and moved by the recovery of the gases, as follows: two holes of approximately 2 mm in diameter after the explosion chamber communicating with the tube in which the piston is situated; if necessary the tube can be, at the start, of a diameter greater than that necessary, and then reduced at the piston: this has the effect of increasing the pressure of the gases and thus the movement speed of the piston (2).

The rod (2) moved by the piston actuates the valve and the pump, returning to the starting position by means of a return spring.

If, however, the compression of the incorporated return spring were to slow the device too much, an independent return spring compressed by separate gas recovery could be used.

The exact position of the two 2-mm holes (or different size) for the recovery of the gases, the diameter and the shape of the tube, the length of the control rod, the need (or not) for independent return, and the synchronisation of the valve and piston could be established during tests in particular with the aid of high-speed photography, or, better still, by use of detectors detecting the passage of the projectile.

The piston will be of a relatively high weight in order to assure the kinetic inertia; by contrast, the other moving parts will together have a weight of approximately less than 10 grams.

For example:

According to the variant shown in FIG. 1 speed of a 7-mm projectile: 900 m/s speed of moving piston: 300 m/s triggering time of the element (4): 0.3 milliseconds after the triggering, the projectile will have travelled: 27 cm the displacement of the closing control mechanism for a 7-mm calibre is 0.4 mm (at 300 m/s) with an amplitude lever of 10×(each flap moving by 4 mm), this being done thus in 0.0013 milliseconds in 0.0013 milliseconds the displacement of the projectile is 1.17 mm in this case the element (4) will therefore be positioned at 27 cm before the flaps volume of gases discharged forwards: 0.039 $cm^3$.

According to the variant shown in FIG. 4 speed of a 7-mm projectile: 900 m/s piston stationary response time of the piston: 0.15 to 0.2 milliseconds in 0.15 milliseconds the projectile will have travelled 13.5 cm before the flaps are closed in this case, the element 1 will therefore be positioned at 13.4 cm before the flaps volume of gases discharged forwards: between 0.039 $cm^3$ (response time 0.15 milliseconds) and 0.175 $cm^3$ (response time of 0.2 milliseconds).

(Note: total volume of the gases if in the open air: 1.12 $m^3$)

The length of the amplitude levers (8) (12) varies depending on the calibre and the sought amplitude effect. If said effect sought is 10, then for 7 mm ammunition (each flap of which will be displaced by 4 mm), the length of the amplitude levers will be approximately 2 cm after the pivot, the control mechanism moving by 0.4 mm. For 12-calibre ammunition (approximately 2 cm diameter), the length of the amplitude levers will be approximately 5 cm after the pivot.

Technical Explanations and Details

In the target field, the operating speed (approximately in milliseconds) is crucial.

The piston will thus already be in motion when the passage of the projectile triggers the device, so as to avoid any latency of the inertia of the setting into motion.

The piston, depending on its weight, its position relative to the weapon chamber, and the calibre of said weapon, will have a speed that may be lower than or equal to, even greater than, that of the projectile (this is of little importance). A variation in the speed of the ammunition is of little importance because it will be translated into a movement difference in the micrometre range, and in addition the piston still receives the same force proportionally.

The speed of the closing of the flaps is, by contrast, of great importance: they must close as quickly as possible. For this, the arms (8, 12) are provided in this case to give a lever with an amplitude of 10, that is to say the proportion of the arm between before and after the pivot is from 1 to 10, that is to say a total length of 11 units. The "compact" version of FIG. 7 serves to reduce this distance. In the "compact" version the first array of levers (12) has a proportion of 1 to 2.5 and the final array (8) of 1 to 4. In this example the total length of 11 units is thus reduced to 5 whilst maintaining an amplitude of 10.

The amplitude (10 in this case) can be increased or decreased as desired. The force generated by the gas recovery is significantly greater than the needs of the device.

The calibres of weapons in respect of inner diameter vary from 5.5 mm to 20 mm. Taking into account the speed of the piston, the amplitude of the lever, and the diameter of the calibre, the gas volume allowed to discharge via the mouth of the barrel before the flaps close can be easily calculated.

For example, for a calibre of 20 mm, a lever amplitude of 10 and a piston speed of 50% relative to the projectile, and a synchronisation safety margin of 1 mm (that is to say the device is triggered 1 mm after the passage of the projectile), the total displacement of the projectile will be 3 mm (0.5 piston speed×10 amplitude lever×2, each flap covering only half, that is to say in total 10 times the speed of the projectile, which will have therefore travelled a tenth of its diameter, that is to say 2 mm). Thus 10 mm×10 mm (radius)×3.1416×3=0.942 $cm^3$ of gas.

The particular features and advantages of the invention are in particular that, equipped with the device of the invention for silencing the noise and neutralising the flash at the mouth of a firearm, no inconvenient noise will exit from the firearm, and the projectiles retain all their properties (speed, accuracy, etc.) without any noise produced by the shock wave. The residual noise is that created by the projectile flying through the air. In addition, the device of the invention is very light and inexpensive.

Nomenclature

| No. | Part name |
|---|---|
| 1 | first gas intake |
| 2 | piston with rod |
| 3 | second gas intake |
| 4 | clutch |
| 5 | transmission |
| 6 | type A control ring |
| 7 | A pivots |
| 8 | A lever arms |
| 9 | return spring for arms 8 |
| 10 | flaps and seat |
| 11 | exhaust pipes |
| 12 | B lever arms |
| 13 | B pivots |
| 14 | control springs |
| 15 | type B control ring |
| 16 | piston cylinder |
| 21 | exhaust junction |
| 22 | opening in tube |
| 23 | tube with flaps |
| 24 | openings in the expansion space |
| 25 | pressure relief valve |
| 26 | return spring |
| 27 | expansion space |

Final Considerations

The proportions and movements have been deliberately exaggerated in the figures and illustrations for reasons of clarity. For example, the part (6, 15) in reality moves only in the millimetre range.

All the parts, their form and their positions can vary without limitation. The recovery or exhaust pipes can be reduced to just one and are not necessarily tubular, the expansion space can be of a different shape, and the control mechanism 6 shown by a full circular ring could be in the form of a circular arc, etc.

The present invention is not in any way limited to the embodiment described by way of example and shown in the drawings. Numerous modifications of the details, shapes and dimensions could be made without departing from the scope of the invention. The present invention has been described with reference to specific embodiments which are purely illustrative and should not be considered limiting. The reference numbers in the claims do not limit the scope thereof.

The invention claimed is:

1. A silencer device for a firearm, in particular for a rifle or another long or short firearm, comprising: at least two closing flaps (10) mounted across an axis on a barrel of the firearm in order to temporarily seal the barrel after ammunition has passed and to prevent the passage of combustion gases and a sound wave towards a mouth of the barrel when a shot is fired, and an actuation unit (2, 4, 5) including at least one opening (1, 3) made in the barrel of the firearm upstream from the closing flaps (10) to form a gas intake (1, 3) that moves a control mechanism (6-9); the control mechanism (6-9) including at least two amplitude lever arms (8, 12) mounted pivotably on pivots (7) attached to the barrel, each amplitude lever arm (8, 12) being coupled to either one of the closing flaps (10), the actuation unit (2, 4, 5) engaging with the control mechanism (6-9) to allow a transverse movement of the closing flaps (10) between an open position, in which the closing flaps (10) allow the ammunition to pass towards the mouth of the barrel, and a closed position, which prevents the passage of the combustion gases and the sound wave after the ammunition has passed, wherein the device further comprises: an exhaust unit (11, 21-27) including at least one exhaust pipe (11, 21) disposed on the barrel upstream from the closing flaps (10) so as to redirect the combustion gases and the sound wave and allow them to be discharged from the barrel, and in that the actuation unit (2, 4, 5) includes an actuation piston that is disposed in a cylinder (16) fixed to the barrel and is extended by a rod (2), the gas intake (1) made in the barrel moving the piston, extended by the rod (2), in a direction generally parallel to the axis of the barrel.

2. The silencer device according to claim 1, wherein the control mechanism (6-9) includes a guide and transmission ring (6) capable of sliding over the barrel, the ring (6) cooperating with the rod of the piston (2) so as to transmit the movement to the lever arms (8).

3. The silencer device according to claim 1, wherein the closing flaps (10) are disposed in a seat placed across the axis of the barrel and are of a predetermined length and are slightly offset from one another along the axis of the barrel, such that they partially overlap one another in the closed position without contacting one another.

4. The silencer device according to claim 1, wherein each closing flap (10) includes an opening for receiving the end of the amplitude lever arm (8) so as to transmit the pivoting movement of the amplitude lever (8) and actuate the closing flap (10) in a transverse direction relative to the axis of the barrel.

5. The silencer device according to claim 1, wherein the guide ring (6) further comprises two wedge-shaped support parts having an angled-edge surface directed towards the closing flaps (10) for enabling the actuation of the lever arms (8) pivoting on the pivots (7) and the closure of the closing flaps (10).

6. The silencer device according to claim 1, wherein the control mechanism (6-9) includes at least one first return spring associated with the guide ring (6) such that said ring resumes its starting position, as the pressure of the gases reduces, and at least one second return spring (9) associated with each of the lever arms (8) so that the lever arms (8) and the closing flaps (10) resume their starting position, as the pressure of the gases reduces.

7. The silencer device according to claim 1, wherein the actuation unit (2, 4, 5) comprises a first and a second opening (1, 3) made in the barrel, the second opening (3) forming a clutch valve (4) actuated by the gas intake (3) so as to allow the rod of the piston (2) to be coupled to the control mechanism (6-9).

8. The silencer device according to claim 1, wherein the actuation unit (2, 4, 5) includes an activation piston (2), which disposed in a cylinder (16) fixed to the barrel and is extended by a rod (2) directly connected to the control mechanism (6-9) by direct contact, the gas intake (1) made in the barrel directly moving the piston, extended by the rod (2), in a direction generally parallel to the axis of the barrel.

9. The silencer device according to claim 1, wherein the actuation unit (2, 4, 5) includes a return spring interposed between the barrel and an activation piston (2), extended by a rod (2), so as to allow the piston rod (2) to resume its starting position, as the pressure in the gas intake (1) reduces.

10. The silencer device according to claim 1, wherein the control mechanism (7-9, 12-15) includes double amplitude lever arms (8, 12) for actuating the closing flaps (10), and a guide ring (15) that actuates two first amplitude lever arms (12) mounted pivotably on first pivots (13) fixed to the barrel, each of the two first amplitude lever arms (12) being coupled to a second amplitude lever arm (8) mounted pivotably on a second pivot (7) fixed to the barrel in order to actuate the second associated amplitude lever arm (8), each of the two amplitude lever arms (8) being coupled to one of the closing flaps (10).

11. The silencer device according to claim 1, wherein the control mechanism (6-9, 12-15) is positioned either upstream from the closing flaps (10) or downstream from the closing flaps (10).

12. The silencer device according to claim 1, wherein the exhaust unit (11, 21-27) also comprises an expansion space (27) connected to said at least one exhaust pipe (11, 21) so as to receive the gases transported by said at least one exhaust pipe (11, 21), the expansion space (27) including vents (24) for discharging the combustion gases from the expansion space (27).

13. The silencer device according to claim 11, wherein the expansion space (27) comprises an inner pipe (23) connected to flaps capable of sealing the vents (24), and wherein the gases enter the expansion space (27) via an opening (22) made in the inner tube (23) once said tube has been pushed to its end position and has thus sealed the vents (24), and, as the pressure reduces, the inner tube (23) resumes its starting position owing to a return spring (26), thus allowing the combustion gases and the sound wave to be discharged from the expansion space (27) via the vents (24).

14. A long or short firearm, in particular a rifle, comprising a silencer device according to claim 1, wherein the barrel of the firearm comprises a fixing system formed by said pivots (7) and a seat disposed across the axis of the barrel, said seat receiving said closing flaps (10) so as to fix the silencer device to the barrel.

15. A method for silencing a firearm, in particular a rifle or another long or short firearm, when a shot is fired, the method comprising the following steps: temporarily sealing a barrel after ammunition has passed and preventing the passage of combustion gases and a sound wave towards a mouth of the barrel when a shot is fired, by means of at least two closing flaps (10) mounted across an axis of the barrel of the firearm, forming a gas intake (1, 3) by means of at least one opening (1, 3) made in the barrel of the firearm upstream from the closing flaps (10), moving an actuation unit (2, 4, 5) and a control mechanism (6-9) by way of the combustion gases in the gas intake (1, 3); the control mechanism (6-9) including at least two amplitude lever arms (8, 12) mounted pivotably on pivots (7) attached to the barrel, each amplitude lever arm (8, 12) being coupled to either one of the closing flaps (10), and generating, by means of the actuation unit (2, 4, 5) and the control mechanism (6-9), a transverse movement of the closing flaps (10) between an open position, in which the closing flaps (10) allow the ammunition to pass towards the mouth of the barrel, and a closed position, which prevents the passage of the combustion gases and the sound wave after the ammunition has passed, wherein the method also comprises the following steps: redirecting the combustion gases and the sound wave and allowing them to be discharged from the barrel by means of an exhaust unit (11, 21-27) including at least one exhaust pipe (11, 21) disposed on the barrel and upstream from the closing flaps (10), and, the actuation unit (2, 4, 5) including an activation piston, which is disposed in a cylinder (16) fixed to the barrel and is extended by a rod (2), moving the piston, extended by the rod (2), in a direction generally parallel to the axis of the barrel by means of the gas intake (1) made in the barrel.

* * * * *